United States Patent [19]

Petersen et al.

[11] Patent Number: 4,875,670

[45] Date of Patent: Oct. 24, 1989

[54] FLOATING IDLER WHEEL ARM ASSEMBLY FOR A DOCUMENT TRANSPORT

[75] Inventors: Borge Petersen, Elmira; William P. Groot, Waterloo, both of Canada

[73] Assignee: NCR Corporation, Dayton, Ohio

[21] Appl. No.: 272,602

[22] Filed: Nov. 17, 1988

[51] Int. Cl.[4] ..... B65H 5/06

[52] U.S. Cl. ..... 271/265; 271/273; 271/81; 198/624; 74/519

[58] Field of Search ..... 271/272, 273, 314, 81, 271/265, 117, 118; 198/624; 74/519

[56] References Cited

U.S. PATENT DOCUMENTS

| | | | |
|---|---|---|---|
| 3,476,381 | 11/1969 | Carlson | 271/117 |
| 4,442,769 | 4/1984 | Kallin | 101/93.19 |
| 4,448,407 | 5/1984 | Bashford et al. | 271/273 |
| 4,461,212 | 7/1984 | Geney | 101/407 R |
| 4,557,473 | 12/1985 | Pecak | 271/229 |
| 4,630,815 | 12/1986 | Petersen et al. | 271/273 |
| 4,655,446 | 4/1987 | Heindke et al. | 271/273 |
| 4,678,178 | 7/1987 | Akiyama et al. | 198/624 |

*Primary Examiner*—H. Grant Skaggs

*Attorney, Agent, or Firm*—Wilbert Hawk, Jr.; Albert L. Sessler, Jr.; Elmer Wargo

[57] ABSTRACT

An idler wheel assembly having an idler wheel arm and an idler wheel rotatably mounted on one end of the arm to co-act with a feed wheel located on one side of a document track when the arm is moved from an inactive to an active position relative to the feed wheel. The arm has a pivot area which is mounted to move along the line which is perpendicular to the document track; this enables the assembly to accommodate documents of varying thicknesses. One embodiment uses a loosely mounted pivot point to effect the movement of the pivot area, and a second embodiment uses an elongated slot in the frame of the assembly to effect the movement of the pivot area along the line mentioned.

20 Claims, 4 Drawing Sheets

HOME POSITION

ACTIVE POSITION

FLOATING IDLER WHEEL ARM ASSEMBLY FOR A DOCUMENT TRANSPORT

BACKGROUND OF THE INVENTION (1) Field of the Invention. This invention relates to an idler wheel assembly used in transporting documents.

(2) Description of the Related Art. In the processing of financial documents, like checks and deposit slips, for example, the documents are moved along a document track in being moved to various processing stations within financial processing machines, like encoders and sorters, for example. In moving the documents, there is generally a feed wheel located on one side of the document track and an idler wheel located on the opposite side of the track. The feed wheel is generally rotated at a constant velocity, and when a document is located between the feed wheel and the idler wheel, the document is moved in a feeding direction along the track.

In some feeding apparatuses, the idler wheel is always in contact with the feed wheel, waiting for a document to be moved therebetween so that the document can be fed further in the feeding direction. This type of apparatus causes excessive wear on both the feed and idler wheels. In other feeding apparatuses, the idler wheel is moved towards the feed wheel only when a document comes between the feed and idler wheels.

One problem associated with document feeders of the type mentioned is that they must handle or move documents which vary in weight and thickness. For example, the documents may range in weight from a thin document having a stock weight of 16 pounds to a thick document having a stock weight of 100 pounds. Very often, the document feeders require adjustments to handle the various thicknesses of documents mentioned. These adjustments are, at times, expensive and time consuming, resulting in down time for the processing machine.

SUMMARY OF THE INVENTION

In contrast with the prior art feeding apparatuses mentioned, the present invention provides a feeding apparatus or assembly which, because of its design, does not need to be adjusted initially or after the assembly is installed in the machine.

Another feature is that the feeding assembly of this invention can handle thin and thick documents of the various stock weights mentioned earlier herein.

Yet another feature is that as the feed and idler rollers of this invention begin to wear in use, no adjustment of the feeding assembly is necessary.

In one aspect of the invention, there is provided an assembly for feeding documents comprising: a frame; a document track mounted on said frame; a feed wheel mounted on one side of said document track, and drive means for rotating said feed wheel; an idler wheel; and moving means for moving said idler wheel between active and inactive positions with respect to said feed wheel; said moving means comprising: an arm having first and second ends and a pivot area therebetween, with said idler wheel being rotatably mounted on said first end; mounting means for mounting said arm at said pivot area to enable said pivot area to move in opposed directions along a line which is substantially perpendicular to said document track while pivoting on said mounting means; resilient means for biasing said idler wheel towards said inactive position; and an actuator for moving said idler wheel towards said active position against the bias of said resilient means when said actuator is energized.

In another aspect of the invention, there is provided an idler wheel assembly for use with a document track having a feed wheel located on one side of the document track, the idler wheel assembly comprising; a frame for securing said idler wheel assembly to said document track; an idler wheel; and moving means for moving said idler wheel between active and inactive positions with respect to said feed wheel; said moving means comprising: an arm having first and second ends and a pivot area therebetween, with said idler wheel being rotatably mounted on said first end; mounting means for mounting said arm at said pivot area to enable said pivot area to move in opposed directions along a line which is substantially perpendicular to said document track while pivoting on said mounting means when said idler wheel assembly is mounted on said document track; resilient means for biasing said idler wheel towards said inactive position; and an actuator for moving said idler wheel towards said active position against the bias of said resilient means when said actuator is energized.

These advantages and others will become more readily understood in connection with the following description, claims, and drawing.

DESCRIPTION OF THE PREFERRED EMBODIMENT

Figure 1:
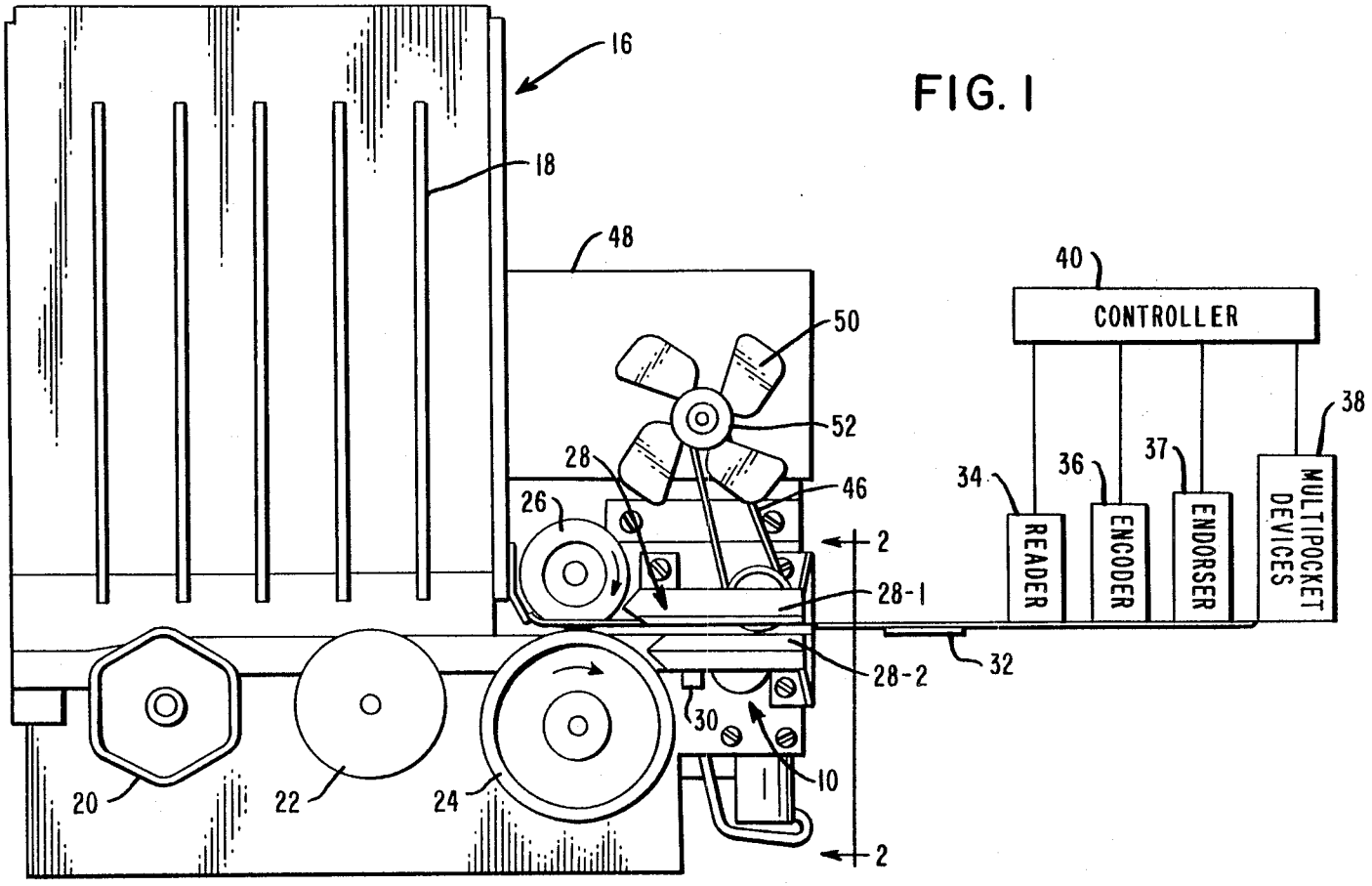
FIG. 1 is a plan view of a processing machine in which the assembly for feeding documents made according to this invention may be used.
Figure 2:
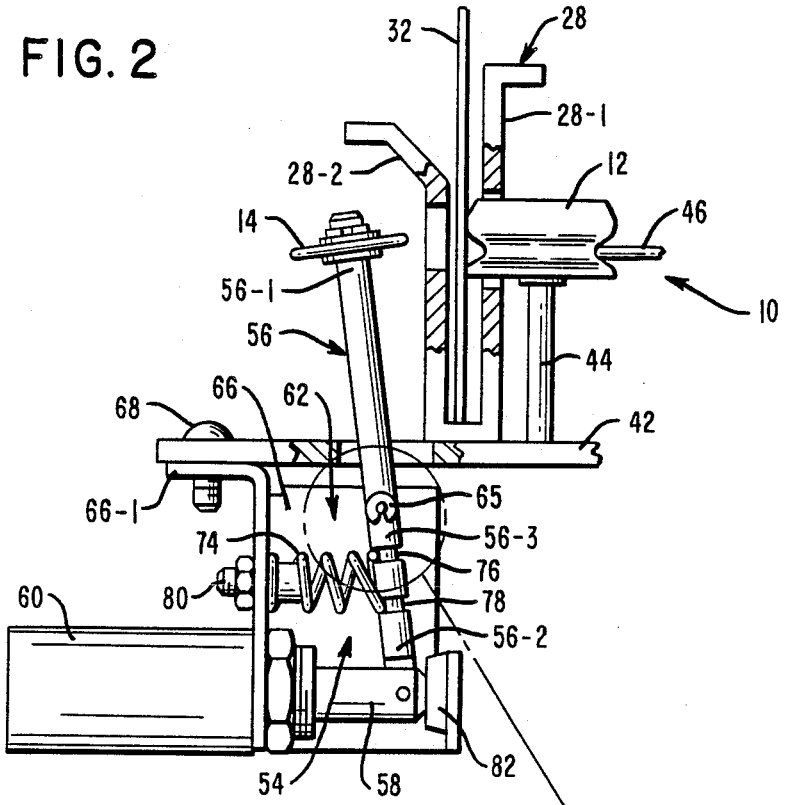
FIG. 2 is an elevational view of a preferred embodiment of this invention, taken along the line 2—2 of FIG. 1, showing an assembly for feeding documents along a document track, with the assembly including an idler wheel which is shown in an inactive position relative the associated drive wheel.

FIG. 2 shows a first preferred embodiment of an assembly for feeding documents along a track, with the assembly being designated generally as 10. The assembly 10 has a feed or drive wheel 12 and an idler wheel 14 which are spaced apart in an inactive position as shown. In order to orient the assembly 10 in a typical environment, it is useful to look at FIG. 1.

FIG. 1 is a plan view of a financial business machine 16 in which the assembly 10 may be used. The machine 16, very generally, includes a hopper 18 for storing a stack of documents, jogger wheel 20, picker wheel 22, advance wheel 24, and stripper wheel 26. The function of the stripper wheel 26 is to singulate the documents so that only one document at a time is fed into the document track 28 which is comprised of upstanding walls 28-1 and 28-2. A sensor 30 is positioned along the document track 28 to detect document movement as will be described hereinafter.

The assembly 10 (FIG. 1) is used to drive or move a document 32 towards a conventional reader 34, encoder 36, endorser 37, and multi-pocket device 38 which are part of the machine 16. Suitable document feed rollers (not shown) are positioned along the document track 28 to feed the documents to the various components mentioned. A controller 40 is used to coordinate or control the activities of the machine 16.

In the embodiment described, the encoder 36 indicates when a document is to be fed from the hopper 18, although the control, obviously, could be initiated elsewhere. When a document 32 is to be fed, a stepping motor (not shown) is energized to rotate the advance wheel 24. As a document is moved towards the sensor 30, the leading edge of the document 30 is used to actuate the assembly 10 after a time delay. The sensor 30 is also used to make sure that a space exists between the trailing edge of one document 32 and the leading edge of a succeeding document 32 being fed in the document track 28. For example, if the sensor 30 does not detect a space between successive documents being fed within a predetermined time out, the controller 40 will shut down the machine 16 because this situation most likely indicates a document jam. Because these aspects of control are conventional, they need not be discussed in any further detail.

In the embodiment described, the peripheral speed of the advance wheel 24 is about 35 inches per second, and the peripheral speed of the drive wheel 12 is about 50–55 inches per second. These speeds produce a feed rate of about 40 documents per minute. Naturally, other speeds could be used for different applications. The drive wheel 12 and the idler wheel 14 are referred to as "soft" drives. In other words, the drive wheel 12 will "slip" on a document 32 without abrading it while the document 32 is being held somewhat by the advance wheel 24 and the associated stripper wheel 26.

The drive wheel 12 and the idler wheel 14, alluded to with regard to the discussion of FIG. 1, are part of the assembly 10 (FIG. 2) for feeding documents along a document track 28. The assembly includes the frame 42 with the document track 28 being mounted thereon. The drive wheel 12 is mounted on the axle 44 which is upstanding from the frame 40 and is secured thereto. The drive wheel 12 has an annular groove on its periphery to receive an "0"-type or circular driving belt 46. Any convenient means may be used to drive or rotate the drive wheel 12. For example, in the embodiment described, the drive wheel is rotated by a motor 48 (FIG. 1) which also rotates a fan 50 to cool the machine 16. The motor 48 has an output pulley 52 which receives the driving belt 46.

Figure 3:
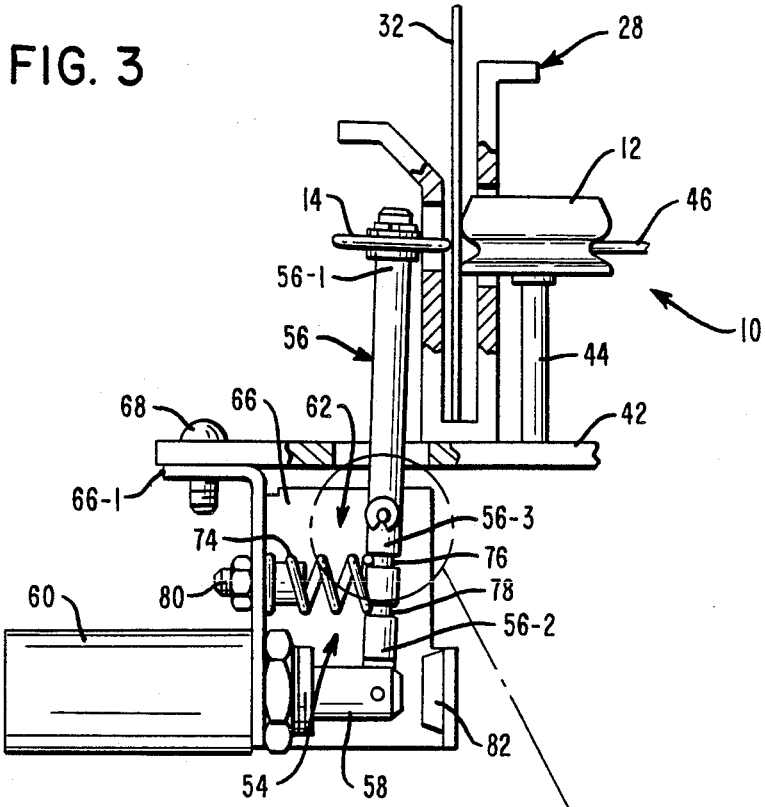
FIG. 3 is a view similar to FIG. 2, showing the idler wheel in an active position with regard to the drive wheel.

The assembly 10 also includes the idler wheel 14 and moving means designated generally as 54 for moving the idler wheel 14 between the home or inactive position shown in FIG. 2 and the active position shown in FIG. 3. The moving means 54 includes the arm 56 which has a first end 56-1, a second end 56-2, and a pivot area 56-3, with the pivot area 56-3 being located between the first and second ends mentioned. The idler wheel 14 is rotatably mounted on the first end 56-1 of the arm 56 while the second end 56-2 is pinned to the operating plunger 58 of a solenoid 60.

Figure 4:
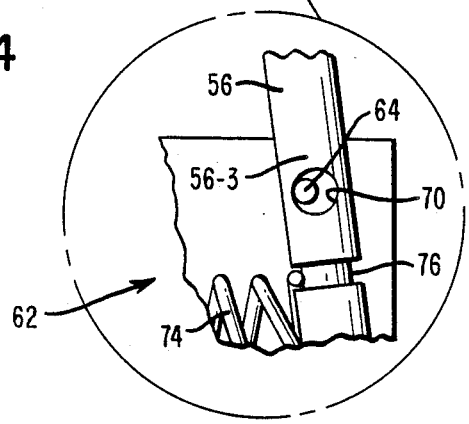
FIG. 4 is an enlarged view of the portion of the assembly shown in the circle in FIG. 2.

The moving means 54 also includes a mounting means 62 (FIG. 4) for mounting the idler wheel arm 56 to enable the pivot area 56-3 of the arm 56 to move in opposed directions along a line which is substantially perpendicular to said document track 28 while pivoting on said mounting means. The mounting means 62 includes a pivot member such as the pin 64 which is shown best in FIG. 4. The pin 64 extends from the bracket or frame 66 which is detachably secured to the frame 42 of the assembly 10 by fasteners, like 68 shown in FIG. 2. The arm 56 is retained on the pin 64 by suitable "C" clips 65. The pivot area 56-3 of the arm has an opening 70 (FIG. 4) therein, with the internal diameter of the opening 70 being greater than the external diameter of the pin 64 as shown in FIG. 4.

The moving means 54 also includes a resilient means (compression spring 74) for biasing the idler wheel 14 towards the inactive position shown in FIG. 2. The arm 56 has first and second annular grooves 76 and 78 thereon to receive on end of the compression spring 74, while the remaining end thereof is retained on a fastener 80 secured to the frame 66. The frame 66 is generally a right angle in shape with a flange 66-1 to enable it to be secured to the frame 42. The method of mounting the compression spring 74 as described provides a low-cost construction.

The solenoid 60, alluded to, is the actuator which moves the idler wheel 14 from the position shown in FIG. 2 to the position shown in FIG. 3. One of the features of the assembly 10 is that it can utilize a low cost solenoid which does not have an internal spring to return the operating plunger to an inactive position. In the assembly 10, the compression spring 74 is used to move the operating plunger 58 to the inactive position shown in FIG. 2 in which it abuts against a rubber bumper 82.

Another feature of the assembly 10 is that the mounting means 62 for the idler wheel arm 56 provides a "floating"mount. This mount enables the assembly 10 to accommodate the tolerances expected in the assembly 10. In this regard, the inner diameter 70 in the arm 56 and the outer diameter of the pin 64 are dimensioned to permit a variation in the throw of the idler wheel arm 56 so as to encompass all the tolerances mentioned. These tolerances include the anticipated wear on the idler and drive wheels 14 and 12 and the range of documents expected to be transported by the assembly 10. For example, the range of documents may vary from documents which are thin having a stock weight of 16 pounds to documents which are thick having a stock weight of about 100 pounds. In one embodiment, the diameter of the pin 64 is 0.0922 inch and the inner diameter 70 in the idler wheel arm 56 is 0.126 inch, with the length of the arm 56 being three inches. Naturally, these dimensions would change for different applications; however they give an example of one such assembly.

Notice from FIG. 3 that when the solenoid 60 is actuated or energized, the idler wheel arm 56 pivots on the pin 64 to move the idler wheel 14 towards the document 32. The controller 40 energizes the solenoid 60 at the appropriate time to make sure that the document 32 is between the idler and drive wheels 14 and 12 when the solenoid 60 is energized. This prevents damage to the leading edge of the document 32 as it encounters the idler and drive wheels 14 and 12. When the solenoid is in the active position shown in FIG. 3, it has essentially bottomed out; however, the idler wheel 14 is resiliently urged into engagement with the document 32 due to the action of compression spring 74 and the mounting means 62 as previously described. Notice from FIG. 5 that the idler wheel arm 56 tends to "float"in that it does not necessarily contact the pin 64. In other words, the compression spring 74 pushes the arm 56, and the idler wheel 14 resiliently contacts the document 32. Notice also, if a thick document 32 were encountered, the idler wheel 14 would be pushed away from the drive wheel 12 to accommodate the thick document 32. However, there would still be some looseness between the pin 64 and the internal diameter 70 to avoid direct contact between the arm 56 and the pin 64, permitting the arm 56 to float as previously described.

Figure 5:
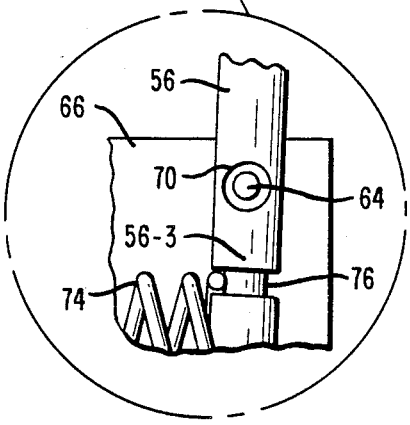
FIG. 5 is an enlarged view of the portion of the assembly shown in the circle in FIG. 3.

When the idler wheel arm 56 is floating as described in relation to FIG. 5, several benefits accrue. Because it is the spring 74 which moves the arm 56, the pressure of the idler wheel 14 on the document 32 appears to be more constant and less likely to damage a document 32. As the drive and idler wheels 12 and 14 tend to wear, no adjustment is necessary for the assembly 10 because some wear was anticipated in designing the looseness between the pin 64 and the diameter of the opening 70. And as previously indicated, thick and thin documents 32 can be handled by the assembly 10.

When the solenoid 60 is de-energized by the controller 40, the compression spring 74 moves the idler wheel 14 to the home position shown in FIG. 2. In doing so, the operating plunger 58 of the solenoid abuts against the rubber bumper 82 by the action of the compression spring 74. The idler wheel 14 has a cross sectional shape which corresponds to the annular recess in the drive wheel 12.

Figure 6:
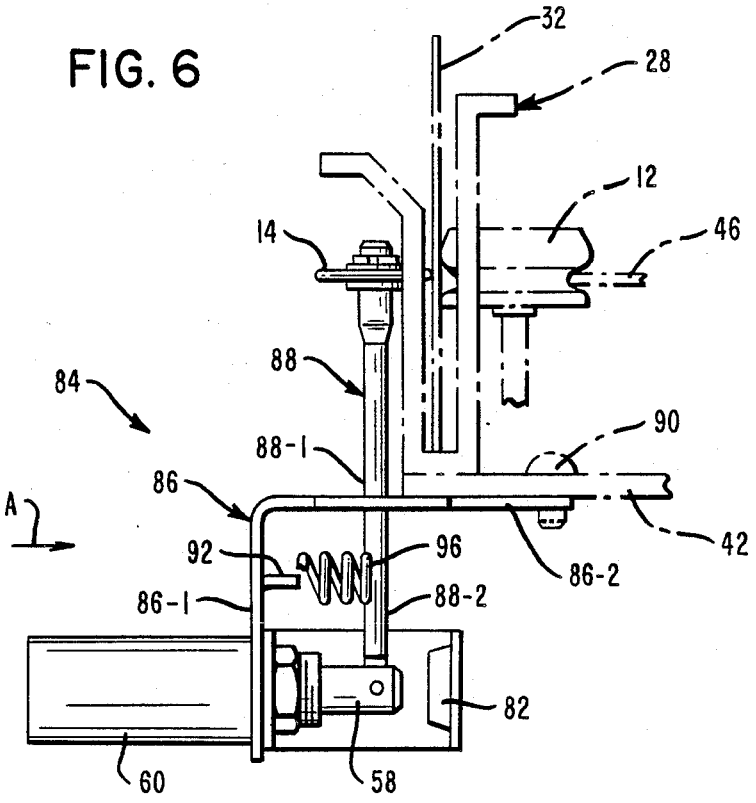
FIG. 6 is a side view, in elevation, similar to FIG. 2, to show a second embodiment of this invention.

FIG. 6 shows another embodiment of an idler wheel assembly designated generally as assembly 84. The assembly 84 includes a bracket or frame designated generally as 86 which enables the assembly 84 to be secured to the frame 42 of a machine like machine 16 shown in FIG. 1. When parts which are used in the second embodiment or assembly 84 are identical to those which are used in the first embodiment or assembly 10 shown in FIG. 2, for example, they are given identical numbers. For example, the idler wheel 14 shown in FIG. 6 is identical to the idler wheel 14 shown in FIG. 2.

Essentially, the operation of the assembly 84 (FIG. 6) is identical to the operation of the assembly 10 shown in FIG. 2; however the mounting means for mounting the idler pivot arm 88 at the pivot area 88-1 is different from that shown in FIG. 2. It should be recalled that the function of the mounting means is to enable the pivot area 88-1 to move along a line which is perpendicular to the document track to provide the floating capability discussed in relation to FIG. 5.

The idler wheel assembly 84 may be considered as a separate article of manufacture to enable it to be incorporated into a machine like machine 16, for example, shown in FIG. 1. The assembly 84 may be secured to the machine 10 by having its frame 86 secured to the frame 42 of the machine 16 by fasteners 90 so that the idler wheel 14 is positioned in operative relationship with the feed roller 12.

Figure 7:
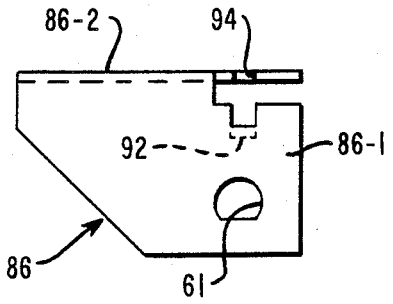
FIG. 7 is a side view of the frame of the second embodiment which is taken along the general direction of line A in FIG. 6.
Figure 8:
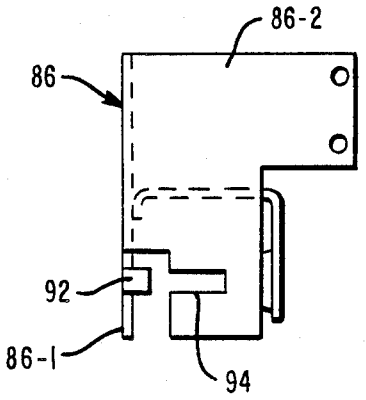
FIG. 8 is a plan view of the frame of the second embodiment shown in FIGS. 6 and 7.

The frame 86 of the assembly 84 includes a side plate 86-1 and a top plate 86-2, with the frame 86 having the general "L"-shaped configuration shown in FIGS. 6-8. The side plate 86-2 has a projection 92 extending therefrom to enable the compression spring 74 to be mounted and retained thereon. The top portion 86-2 functions as a mounting flange to enable the assembly 84 to be secured to the frame 42 of the machine 16. The top plate 86-2 also has a slot 94 formed therein, with the slot 94 being aligned perpendicularly relative to the document track 28. The slot 94 is dimensioned to receive the arm 88 as shown in FIG. 6. The slot 94 is also aligned (in a vertical direction) with the longitudinal axis of the operating plunger 58 of the solenoid 60. The side plate 86-1 has a hole 61 therein to receive the solenoid 60. The lower end 88-2 of the arm 8 (as viewed in FIG. 6) is pivotally joined to the operating plunger 58 of the solenoid 60. The arm 88 has a single recess 96 at the pivot area 88-1 thereof to receive one end of the compression spring 74, with the other end of the spring being mounted on the projection 92. The spring 74 and the slot 94 in the frame 94 provide a mounting means for mounting the arm 88 at the pivot area 88-1 to enable the pivot area 881 to move along a line whose direction is towards and away from the document track 28, with this line being substantially perpendicular to this track. The movement of the idler wheel arm 88 to the inactive position (corresponding to arm 56 in FIG. 2) is limited by the action of the operating plunger 58 of the solenoid abutting against the bumper 82 when the solenoid is de-energized.

A feature of the second embodiment or assembly 84 is that the tolerances for which the assembly 84 is to respond are easier to set than they are in the first embodiment or assembly 10. Another feature is that the assembly 84 is easier to manufacture than the assembly 10.

What is claimed is:

1. An assembly for feeding documents comprising:
a frame;
a document track mounted on said frame;
a feed wheel mounted on one side of said document track, and drive means for rotating said feed wheel;
an idler wheel; and
moving means for moving said idler wheel between active and inactive positions with respect to said feed wheel;
said moving means comprising:
an arm having first and second ends and a pivot area therebetween, with said idler wheel being rotatably mounted on said first end;
mounting means for mounting said arm at said pivot area to enable said pivot area to move in opposed directions along a line which is substantially perpendicular to said document track while pivoting on said mounting means;
resilient means for biasing said idler wheel towards said inactive, position; and
an actuator for moving said idler wheel towards said active position against the bias of said resilient means when said actuator is energized.

2. The assembly as claimed in claim 1 in which said resilient means includes a compression spring which is mounted between said pivot area and said second end of said arm.

3. The assembly as claimed in claim 2 in which said actuator is a solenoid having its operating plunger connected to said second end of said arm; said solenoid having no return spring therein and said compression spring being used to move said operating plunger to a home position while simultaneously moving said idler wheel to said inactive position when said solenoid is de-energized.

4. The assembly as claimed in claim 3 in which said feed wheel has an annular recess therein and said idler wheel has a conforming shape to enable said conforming shape to be received in said annular recess when no document is positioned between said feed and idler wheels.

5. The assembly as claimed in claim 4 in which said mounting means enables said pivot area to move along said line a first distance which enables the idler wheel to move a second distance, with said second distance corresponding to the difference in thickness between a thin document and a thick document positioned between the feed and idler wheels.

6. The assembly as claimed in claim 5 in which said second distance corresponds to the difference in thickness between thin and thick documents ranging in stock weights between approximately 16 and 100 pounds, respectively.

7. The assembly as claimed in claim 6 in which said moving means includes a controller and also includes a sensor coupled to said controller, with said sensor being positioned along said track to provide an output signal when a document is positioned between said feed wheel and said idler wheel, said controller being effective to energize said solenoid upon receiving said control signal to move said idler wheel towards said active position.

8. The assembly as claimed in claim 2 in which said mounting means includes a pivot member supported in said frame and having a first diameter, and in which said arm has an opening therein at said pivot area with said opening having a second diameter, said arm being rotatably mounted on said pivot member via said opening, and said second diameter being larger than said first diameter to enable said idler wheel to move away from said drive wheel against the bias of said compression spring in order to accommodate documents of varying thicknesses between said feed and idler wheels.

9. The assembly as claimed in claim 3 in which said mounting means includes a pivot member supported in said frame and having a first diameter and in which said arm has an opening therein at said pivot area, with said opening having a second diameter, said arm being rotatably mounted on said pivot member via said opening, and said second diameter being larger than said first diameter to enable said idler wheel to move away from said drive wheel against the bias of said compression spring in order to accommodate documents of varying thicknesses between said feed and idler wheels.

10. The assembly as claimed in claim 9 in which said mounting means includes a bracet which is detachably secured to said frame, and in which said pivot member, spring, and solenoid are mounted on said bracket, and in which said mounting means also includes a stop mounted on said bracket to enable said operating plunger of said solenoid to abut thereagainst when said solenoid is de-energized.

11. The assembly as claimed in claim 3 in which said mounting means includes a bracket which is detachably secured to said frame, and in which said pivot member, said spring, and solenoid are mounted on said bracket;

said bracket having an elongated slot therein, with said elongated slot being aligned substantially perpendicular to said document track; and said pivot area of said arm being positioned in said elongated slot to enable said arm to pivot along said line.

12. The assembly as claimed in claim 11 in which said elongated slot is aligned substantially perpendicular to said document track.

13. An idler wheel assembly for use with a document track having a feed wheel located on one side of the document track, the idler wheel assembly comprising;

a frame for securing said idler wheel assembly to said document track;

an idler wheel; and moving means for moving said idler wheel between active and inactive positions with respect to said feed wheel;

said moving means comprising:

an arm having first and second ends and a pivot area therebetween, with said idler wheel being rotatably mounted on said first end;

mounting means for mounting said arm at said pivot area to enable said pivot area to move in opposed directions along a line which is substantially perpendicular to said document track while pivoting on said mounting means when said idler wheel assembly is mounted on said document track;

resilient means for biasing said idler wheel towards said inactive position; and an actuator for moving said idler wheel towards said active position against the bias of said resilient means when said actuator is energized.

14. The idler wheel assembly as claimed in claim 13 which said resilient means includes a compression spring which is mounted between said pivot area and said second end of said arm.

15. The idler wheel assembly as claimed in claim 14 in which said actuator is a solenoid having its operating plunger connected to said second end of said arm; said solenoid having no return spring therein and said compression spring being used to move said operating plunger to a home position while simultaneously moving said idler wheel to said inactive position when said solenoid is de-energized.

16. The idler wheel assembly as claimed in claim 15 in which said mounting means enables said pivot area to move along said line a first distance which enables the idler wheel to move a second distance, with said second distance corresponding to the difference in thickness between a thin document and a thick document positioned between the feed and idler wheels.

17. The idler wheel assembly as claimed in claim 14 in which said mounting means includes a pivot member supported in said frame and having a first diameter, and in which said arm has an opening therein at said pivot area with said opening having a second diameter, said arm being rotatably mounted on said pivot member, and said second diameter being larger than said first diameter to enable said idler wheel to move away from said drive wheel against the bias of said compression spring in order to accommodate documents of varying thicknesses between said feed and idler wheels.

18. The idler wheel assembly as claimed in claim 17 in which said pivot member, spring, and solenoid are mounted on said frame, and in which said frame also includes a stop mounted thereon to enable said operating plunger of said solenoid to abut against said stop when said solenoid is de-energized.

19. The idler wheel assembly as claimed in claim 14 in which said mounting means includes a bracket which is detachably secured to said frame, and in which said pivot member, said spring, and solenoid are mounted on said bracket;

said bracket having an elongated slot therein, with said elongated slot being aligned substantially perpendicular to said document track; and said pivot area of said arm being positioned in said elongated slot to enable said arm to pivot along said line.

20. The idler wheel assembly as claimed in claim 19 in which said elongated slot is aligned substantially perpendicular to said document track.

* * * * *